US010888972B2

(12) United States Patent
Kubis et al.

(10) Patent No.: US 10,888,972 B2
(45) Date of Patent: Jan. 12, 2021

(54) DRY ICE CONTAINER FOR DRY ICE CLEANING DEVICES

(71) Applicant: ICS ICE CLEANING SYSTEMS S.R.O., Povazská Bystrica (SK)

(72) Inventors: Ivan Kubis, Povazská Bystrica (SK); L'udovít Bakala, Povazská Bystrica (SK); Peter Gabris, Povazská Bystrica (SK)

(73) Assignee: ICS ICE CLEANING SYSTEMS S.R.O.

( * ) Notice: Subject to any disclaimer, the term of this patent is extended or adjusted under 35 U.S.C. 154(b) by 222 days.

(21) Appl. No.: 15/755,211

(22) PCT Filed: Aug. 29, 2016

(86) PCT No.: PCT/SK2016/050009
§ 371 (c)(1),
(2) Date: Feb. 26, 2018

(87) PCT Pub. No.: WO2017/039548
PCT Pub. Date: Mar. 9, 2017

(65) Prior Publication Data

US 2018/0243884 A1 Aug. 30, 2018

(30) Foreign Application Priority Data

Aug. 29, 2015 (SK) ..... 50047-2015

(51) Int. Cl.
*B24C 7/00* (2006.01)
*B24C 1/00* (2006.01)

(52) U.S. Cl.
CPC ..... *B24C 7/0069* (2013.01); *B24C 1/003* (2013.01); *B24C 7/00* (2013.01); *B24C 7/0092* (2013.01)

(58) Field of Classification Search
CPC ..... B24C 1/003; B24C 7/00; B24C 7/0046; B24C 7/0069; B24C 7/0092; B65G 53/40; F28G 1/12
(Continued)

(56) References Cited

U.S. PATENT DOCUMENTS 1,730,195 A * 10/1929 Davis ..... B24C 7/0046 451/99
4,744,181 A 5/1988 Moore et al.
(Continued)

FOREIGN PATENT DOCUMENTS

CN 1093024 10/1994
CN 2367614 3/2000
(Continued)

OTHER PUBLICATIONS

International Search Report dated Dec. 13, 2016 in corresponding PCT International Application No. PCT/SK2016/050009.
(Continued)

*Primary Examiner* — Eileen P Morgan
*Assistant Examiner* — Marcel T Dion
(74) *Attorney, Agent, or Firm* — Ostrolenk Faber LLP

(57) ABSTRACT

Dry ice container for dry ice cleaning devices comprises the container for dry ice closed by the lid (2) on the upper side, and provided by the opening (3) for drawing out dry ice pellets on the lower side. The container (1) has the bottom (4) sloped towards the opening (3) for drawing out the pellets. The linear-movable member (5) is arranged in the chamber (6) at the bottom (4) of the container (1) transversely to the axis of the container (1). The member (5) has the shape of a gutter in which groups of separated openings (5*a*, 5*b*, 5*c*) are provided, to which at least one pellets
(Continued)

plowing element (5*d*) is placed in the member (5). Each group of openings (5*a*, 5*b*, 5*c*) pertains to one opening (3) for drawing out the pellets.

2 Claims, 3 Drawing Sheets

(58) Field of Classification Search
USPC ..... 451/94, 99, 446
See application file for complete search history.

(56) References Cited

U.S. PATENT DOCUMENTS

| | | | | |
|---|---|---|---|---|
| 5,123,206 | A | 6/1992 | Woodson | 51/320 |
| 5,319,946 | A | 6/1994 | Manificat | |
| 5,415,584 | A * | 5/1995 | Brooke | B08B 7/00 134/7 |
| 5,593,066 | A | 1/1997 | Konuma et al. | |
| 6,000,995 | A * | 12/1999 | Ruholl | B24C 5/04 451/2 |
| 7,040,959 | B1 * | 5/2006 | Panuska | B24C 5/02 239/310 |
| 8,398,460 | B2 * | 3/2013 | Christopher | B24C 3/327 451/100 |
| 8,430,722 | B2 | 4/2013 | Raeder et al. | |
| 9,339,855 | B2 * | 5/2016 | Hochfellner | B08B 9/057 |
| 9,925,636 | B2 * | 3/2018 | Maeda | B24B 31/02 |
| 2003/0064665 | A1 * | 4/2003 | Opel | B24C 1/003 451/40 |
| 2003/0224704 | A1 * | 12/2003 | Shank | B24C 1/086 451/38 |
| 2006/0205326 | A1 * | 9/2006 | Dressman | B24C 1/003 451/38 |
| 2008/0099182 | A1 | 5/2008 | Bham et al. | |
| 2009/0075569 | A1 | 3/2009 | Mase et al. | 451/99 |
| 2010/0024441 | A1 | 2/2010 | Yeung | |

FOREIGN PATENT DOCUMENTS

| | | |
|---|---|---|
| CN | 101175678 | 5/2008 |
| CN | 101932409 | 12/2010 |
| CN | 102272015 | 12/2011 |
| DE | 10 2005 057 115 | 5/2007 |
| DE | 11 2008 000 816 B4 | 4/2011 |
| EP | 0 268 449 A2 | 5/1988 |
| EP | 0 521 794 | 1/1993 |
| EP | 0 786 311 | 7/1997 |
| EP | 1 769 886 A1 | 4/2007 |
| EP | 2 832 499 A1 | 2/2015 |
| JP | 63-127875 | 5/1988 |
| JP | 1-183369 | 7/1989 |
| JP | 2002-79465 | 3/2002 |
| JP | 2006-123035 | 5/2006 |
| JP | 2008-68341 | 3/2008 |
| JP | 2012-161884 | 8/2012 |
| WO | WO 95/08407 A1 | 3/1995 |
| WO | WO 2009/096122 | 8/2009 |

OTHER PUBLICATIONS

Written Opinion dated Dec. 13, 2016 in corresponding PCT International Application No. PCT/SK2016/050009.
Chinese Search Report dated Jun. 27, 2019 issued in Chinese Application No. 201680050264.5.
Canadian Examination Search Reported dated Nov. 9, 2018 issued in Canadian Application No. 2,996,488.
Japanese Office Action dated Feb. 19, 2019 issued in Japanese Application No. 2018-511050.
Slovakia Search Report dated Mar. 18, 2016 issued in the corresponding Slovakia application.

* cited by examiner

DRY ICE CONTAINER FOR DRY ICE CLEANING DEVICES

CROSS-REFERENCE TO RELATED APPLICATIONS

The present application is a 35 U.S.C. §§ 371 national phase conversion of PCT/SK2016/050009, filed Aug. 29, 2016, which claims priority to Slovakia Patent Application No. PP50047-2015, filed Aug. 29, 2015, the contents of which are incorporated herein by reference. The PCT International Application was published in the English language.

TECHNICAL FIELD

The technical solution relates to dry ice container for dry ice cleaning devices, particularly for so-called two-hose devices for dry ice blasting. Dry ice means solid $CO_2$, and the two-hose device means a device which comprises a pair of lines which enters the mixing node, which is realized by Venturi tube integrated in the body of the blast gun, while one line supplies compressed air and the second line supplies dry ice pellets using negative pressure.

BACKGROUND ART

There are known dry ice containers for dry ice cleaning devices comprising a container, in which dry ice is drawn out by negative pressure to the blast gun. In said containers, air is drawn through the entire volume of the container, so is through the entire volume of dry ice present in the container, what results in degradation of dry ice pellets by humidity contained in atmospheric air. The pellets tend to form lumps, which hinder correct function of the entire cleaning device. This drawback is solved such that a device is provided for crushing of dry ice, or for reducing the size of the pellets, placed at the bottom of the container, so the pellets could pass through the openings at the bottom of the container to the outlet port and to be drawn out by negative pressure to the blast gun. Container of this type is disclosed in e.g. EP 2832499 A1.

Problem of providing substantially homogenous, or continuous flow of drawn out dry ice pellets is also being solved in EP 1 769 886 A1. The device comprises a container for dry ice, into which a hose for drawing out the pellets is inserted at its bottom, whereas this hose can make reciprocal motion and against this hose, a pipe for supplying atmospheric air discharges in sloped bottom part of the container. The pipe for supplying atmospheric air supports drawing out the pellets and its discharge in the bottom part of the container before the suction hose of the pellets ensures that the entire volume of pellets present in the container is not exposed to the flow of air. Motion of the hose for sucking out the pellets then provides for the movement of pellets near the hose suction tip, thus preventing choking of the suction channel. The hose for sucking out the pellets moves in the direction of the axis of the container and against stop-end plate at discharge of the pipe for supplying the pressurized air. Such arrangement allows to reduce size of the pellets. Described solution is in certain scope able to provide problem free transport of the pellets to the blast gun. However, this device is characterized by relatively complex construction and relatively small section for the flow of pellets, what can, despite the measures proposed in this solution, lead to the blocking of the flow of pellets. Further, due to the fact that atmospheric air is supplied to the pellets, the chance of generation of lumps or clusters is still present, even despite the short distance of travel of air through the pellets.

The object of this solution is to provide a container, which would be characterized in simpler construction and efficient operation, while generation of clusters of pellets would be reduced to minimum, or even fully prevented.

DISCLOSURE OF INVENTION

Said object is attained by dry ice container for dry ice cleaning devices according to this invention, which comprises a container (1) for dry ice closed by a lid (2) on the upper side, and provided by an opening (3) for drawing out dry ice pellets on the lower side, where the container (1) has the bottom (4) sloped towards the opening (3) for drawing out the pellets, at which linear-movable member (5) is arranged, and supply of auxiliary air is discharged above the bottom (4) of the container (1), characterized in that the linear-movable member (5) is arranged in a chamber (6) at the bottom (4) of the container (1) transversely to the axis of the container (1), where the member (5) has the shape of a gutter in which groups of separated openings (5*a*, 5*b*, 5*c*) are provided, to which at least one pellets plowing element (5*d*) is placed in the member, each group of openings (5*a*, 5*b*, 5*c*) pertains to one opening (3) for drawing out the pellets, where the openings (3) for drawing out the pellets are connected through a collector (7) to an outlet (8) of the pellets, the member (5) is connected to the piston of pneumatic cylinder (10), and the supply of auxiliary air above the bottom (4) of the container (1) is formed by a tubular body (11) (12) transversely extending through the container (1) in the direction of the member (5), where the body (11) (12) is outside the container (1) at one end connected to a source of auxiliary air, inside the container (1) it is provided at least by one opening (12) (13) of the outlet of auxiliary air arranged against the bottom (4) of the container (1), and on the other end outside the container (1) it is provided by an opening (13) (14) for the outlet of residual auxiliary air.

It is preferred, if the source of auxiliary air is the outlet of dump operating air from the pneumatic cylinder (10).

BRIEF DESCRIPTION OF DRAWINGS

This invention is better explained on accompanying drawings, where.

Arrows or arrows with associated lines shown in drawings represent respective directions and flows of the air, or air with pellets in the entire device and the container.

MODE(S) FOR CARRYING OUT THE INVENTION

Figure 1:
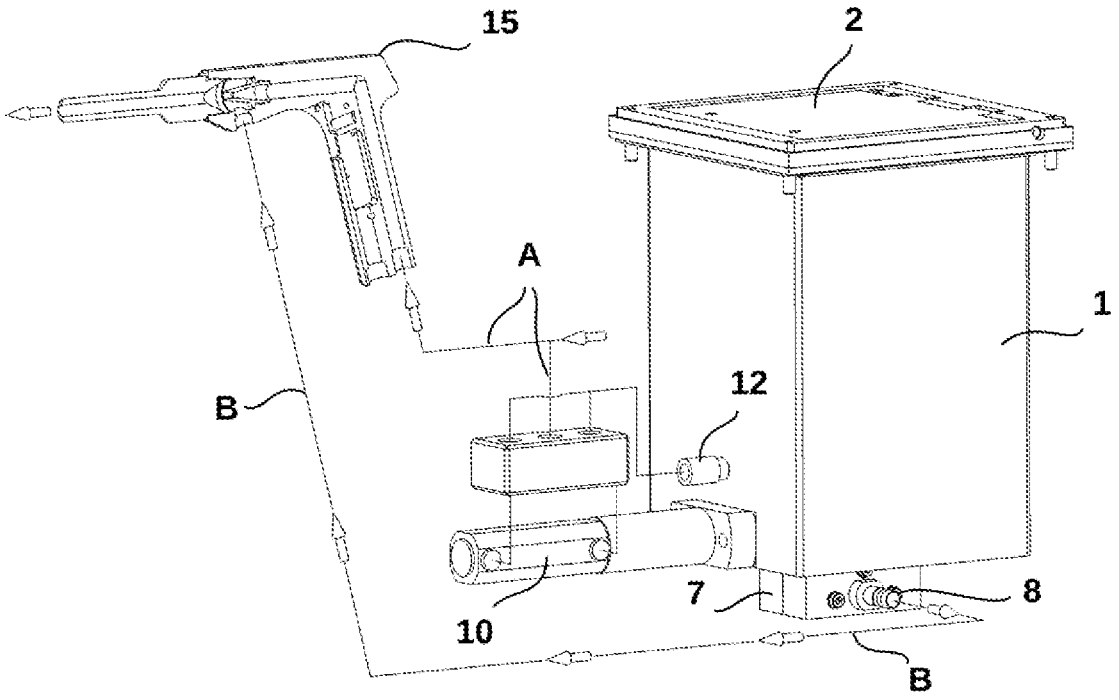
FIG. 1 shows overall outside view of the container according to this invention with schematic connection of the blast gun.

The device comprising the container 1 according to this invention is schematically shown in FIG. 1. The device is composed of pair of lines leading to the mixing node, which is realized by Venturi tube integrated in the body of blast gun 15. The first line A (positive pressure) represents the inlet system of gaseous medium. The second line B (negative pressure) serves for transport of the pellets to the mixing chamber in the blast gun 15.

Figure 2:
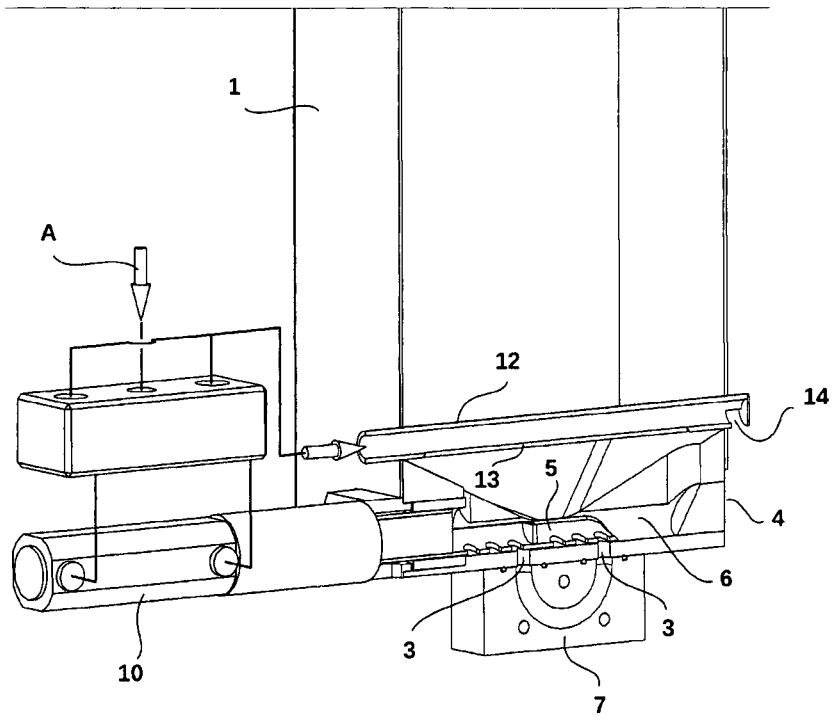
FIG. 2 shows the view of the lower part of the container of FIG. 1 in partial section.
Figure 3:
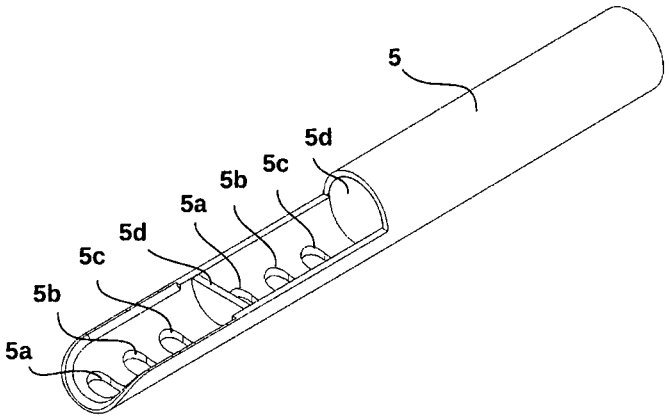
FIG. 3 shows overall view of the linear-movable member.
Figure 4:
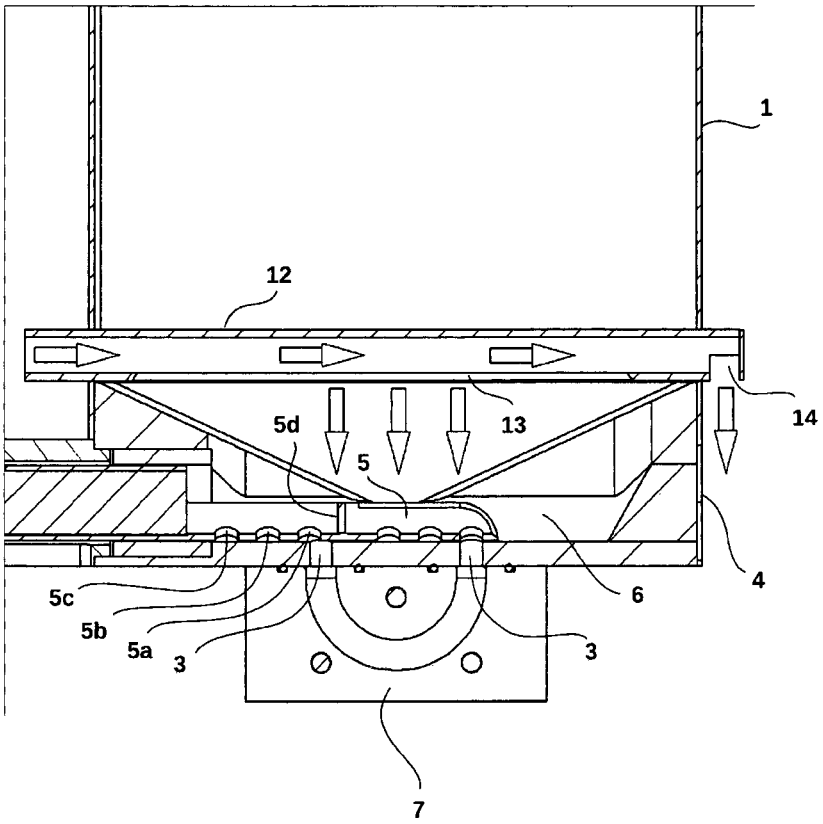
FIG. 4 shows the lower part of the container according to this invention in side sectional view.

Dry ice container for dry ice cleaning devices according to this invention, according to FIGS. 2 to 4 comprises the container 1 for dry ice closed by the lid 2 on the upper side, and provided by the opening 3 for drawing out dry ice pellets on the lower side. The container 1 has the bottom 4 sloped towards the opening 3 for drawing out the pellets. Linear-movable member 5 is arranged transversely to the axis of the container 1, in the chamber 6 at the bottom 4 of the container 1. The member 5 is in the form of a gutter, in which groups of separated openings 5*a*, 5*b*, 5*c* are provided. To each group of the openings 5*a*, 5*b*, 5*c*, the pellets plowing element (5*d*) is placed in the member 5. Each group of openings 5*a*, 5*b*, 5*c* pertains to one opening 3 for drawing out the pellets, the number of which is in this example two. The openings 3 for drawing out the pellets are connected through the collector 7 to the outlet 8 of the pellets. The member 5 is connected to the piston of pneumatic cylinder 10. The supply of auxiliary air at the bottom 4 of the container 1 is formed by tubular body 12 transversely extending through the container 1 in the direction of the member 5. The body 12 is outside the container 1 at one end connected to the source of auxiliary air. The body 12 is inside the container 1 provided by at least one opening 13 of the outlet of auxiliary air, which is arranged against the bottom 4 of the container 1. The body 12 is on the other end outside the container 1 provided by the opening 14 for outlet of residual auxiliary air.

Pellets are inserted into the container 1. The pellets are supplied to opened chamber 6 by the gravity and sloping of the bottom 4 of the container 1. Movable gutter, i.e. the member 5 performs linear reciprocation motion through the pellets, while pellets plowing element 5*d* creates above the openings 3 for drawing out the pellets, which are continuously consecutively opened by the openings 5*a*, 5*b*, 5*c* and closed by solid areas between these openings 5*a*, 5*b*, 5*c*, the air gaps that are subsequently filled with incoming pellets. The pellets are passing to suction openings 3 through the member 5 by the openings 5*a*, 5*b*, 5*c* during their transition over the suction openings 3. In this example of embodiment, the number of the openings 5*a*, 5*b*, 5*c* is three. The outer openings 5*a*, 5*c* provide for the flow of the pellets to the opening 3 at the end positions of the member 5 and the middle opening 5*b* provides for the flow of the pellets also during the motion of the member 5 (not only at the end positions), thus ensuring continuity of the flow of the pellets to respective opening 3. The number, shape and spacing of the openings 5*a*, 5*b*, 5*c*, can be adjusted according to the needs, and so can be the number and shape of the plowing elements 5*d*. In this example of embodiment, the plowing elements 5*d* are in the form of walls, each of them pertaining to one group of openings 5*a*, 5*b*, 5*c*. Moving member 5 is plowing the pellets, i.e. preventing formation of clusters of pellets, in front of the openings 3, while by continuous consecutive opening and closing of the openings 3 for drawing out the pellets, is preventing their blockage by the pellets drawn in from above and regulates amount of passing pellets.

The flow of pellets is supported by supply of the auxiliary air to the pellets in the lower part of the container 1, i.e. in the area of the bottom 4, where the pellets shortly after enter the opened chamber 6. Preferably, working air dumped from the pneumatic cylinder 10 that serves to drive the member 5, is supplied to the tubular body 12. Part of the volume of passing air supplies feeding system of the device through the opening 13 of the outlet of auxiliary air, the most preferably in the shape of longitudinal groove, aperture. This system supplies the container 1 with sufficient volume of treated air, the system takes from this source adequate amount and the redundant part is dumped through the opening 14 for the outlet of residual auxiliary air. As was mentioned above, the pneumatic system, i.e. pneumatic cylinder 10 is preferably used as the source of auxiliary air, because this air is passing through purification and humidity separation before its use, thus its adverse effect on quality of the pellets decreases.

Above described example of embodiment represents only one particular construction embodiment of the container according to this invention, while this example is introduced only as an illustrative example to explain the principle of the technical solution and it is not in any way limiting also for other constructional variants within the scope of the claims.

The invention claimed is:

1. A dry ice container for a cleaning device comprising:

a container for dry ice pellets, the container comprising a lid on an upper side and provided with at least two pellet openings for drawing out said dry ice pellets on a lower side of the container to send drawn out pellets to the cleaning device, wherein the container has a bottom sloped towards the at least two pellet openings;

a linear-movable member arranged in a chamber at the bottom of the container above the at least two pellet openings and transversely to a central vertical axis of the container, wherein the linear-movable member has the shape of a gutter with an open top for catching ice pellets from the container and a bottom surface in which at least two groups of a plurality of member openings are formed, wherein at least one pellets plowing element is positioned on the linear-movable member between the at least two groups of member openings thereby separating the at least two groups of member openings, wherein each group of separated member openings moves over a respective one of the pellet openings for allowing the ice pellets in the linear-movable member to pass from the member openings into the respective pellet opening, wherein the linear-movable member is connected to a piston of a pneumatic cylinder; and a tubular body for supplying auxiliary air, the tubular body extending through the container transversely to the central vertical axis of the container and having a first end outside the container, a second end outside the container and an intermediate section inside the container, the first end connected to a source of auxiliary air, the intermediate section having at least one opening serving as a first outlet of auxiliary air arranged facing the bottom of the container, and the second end has an opening serving as a second outlet of residual auxiliary air; and wherein the pellet openings are in communication with a collector, the collector having an outlet for transferring the pellets to the cleaning device.

2. The dry ice container according to claim 1, wherein the source of auxiliary air is an outlet of the pneumatic cylinder.

* * * * *